US005752888A

United States Patent [19]

Maruko et al.

[11] Patent Number: 5,752,888

[45] Date of Patent: May 19, 1998

[54] THREAD-WOUND GOLF BALLS

[75] Inventors: Takashi Maruko; Junji Hayashi, both of Saitama, Japan

[73] Assignee: Bridgestone Sports Co., Ltd., Tokyo, Japan

[21] Appl. No.: 659,259

[22] Filed: Jun. 6, 1996

[30] Foreign Application Priority Data

Jun. 7, 1995 [JP] Japan ..... 7-164776

[51] Int. Cl.[6] ..... A63B 37/06; A63B 37/12

[52] U.S. Cl. ..... 473/361; 473/365; 473/373; 473/378; 473/377; 273/DIG. 20

[58] Field of Search ..... 473/357, 361, 473/363, 364, 365, 373, 378, 377

[56] References Cited

U.S. PATENT DOCUMENTS 5,397,129 3/1995 Kato et al. ..... 473/365

5,445,387 8/1995 Maruko et al. ..... 473/357 X 5,586,950 12/1996 Endo ..... 473/378 X

*Primary Examiner*—George J. Marlo

*Attorney, Agent, or Firm*—Sughrue, Mion, Zinn, Macpeak & Seas, PLLC

[57] ABSTRACT

A thread-wound golf ball comprising: a thread rubber ball prepared by winding thread rubber around a spherical center, and a cover enclosing the thread rubber ball therewith, which golf ball has a deformation under a load of 100 kg of from 2.5 to 3.7 mm, and wherein the center has an intrinsic frequency of from 2,000 to 4,000 Hz, an outer diameter of from 31 to 35 mm, a deformation under a load of 30 kg in the range of 1.2 to 2.6 mm, and a weight of from 19.5 to 29.0 g.

10 Claims, 4 Drawing Sheets

THREAD-WOUND GOLF BALLS

BACKGROUND OF THE INVENTION

1. Field of the Invention

The present invention relates to a thread-wound golf ball comprising a solid center.

2. Related Art

Thread-wound golf balls are prepared by winding thread rubber around a center to form a thread rubber ball, and then enclosing the thread rubber ball with a cover. There are two types of centers, i.e., a liquid center and a solid center. The liquid center is prepared by enclosing a liquid in a spherical rubber bag, whereas the solid center is prepared by molding synthetic rubber into spherical shape.

The thread-wound golf balls with a liquid center exhibit soft feel on impact due to softness of the liquid center, as compared to those with a solid center. On the other hand, the thread-wound golf balls with a solid center are advantageous in travel distance because of their high coefficient of restitution.

A golf player's feeling when hitting a golf ball is one factor to choose a golf ball as well as travel distance. The golf player's feeling mainly includes two types, i.e., feel on impact when hitting a golf ball, and impact sound generated upon impact between a club and a golf ball. In this case, a skilled golf player prefers reasonably soft and firm feel on impact and good "click" sound.

However, the conventional thread-wound golf balls with a solid center are advantageous in that they give good travel distance, but are disadvantageous in that good "click" sound preferred by a skilled golf player (impact sound inherent to a thread-wound golf ball with a water-based liquid center), cannot be obtained. Further, the conventional thread-wound golf balls with a solid center are not sometimes preferred by a skilled golf player due to their solid feel on impact as compared to those with a liquid center.

It is desired to provide a thread-wound golf ball giving good "click" sound with reasonably soft and firm feel on impact, and also one improving the advantage inherent to a golf ball with a solid center, i.e., good travel distance.

SUMMARY OF THE INVENTION

In view of the above situations, the present inventors made intensive studies, and, as a result, it was found that good "click" sound has a frequency of about 3,200 Hz and that such impact sound can be obtained by using a solid center having an intrinsic frequency close to the frequency of the above click sound. Also, it was found that feel on impact can be improved when the intrinsic frequency of the solid center is made closer to the frequency of the above click sound; that the travel distance can be improved without sacrificing the above good impact sound and the good feel on impact when the solid center used is a large solid center having an outer diameter of from 30 to 35 mm and a weight of from 19.5 to 29.0; and that the travel properties, spin properties and feel on impact can be further improved when the resulting golf ball has a deformation of from 2.5 to 3.7 mm under a load of 100 Kg. The present invention was made based on these findings.

According to the present invention, there is provided a thread-wound golf ball comprising a thread rubber ball prepared by winding thread rubber around a spherical center, and a cover enclosing the thread rubber ball therewith, which golf ball has a deformation under a load of 100 Kg of from 2.5 to 3.7 mm, and wherein the center has an intrinsic frequency of from 2,000 to 4,000 Hz, an outer diameter of from 30 to 35 mm and a weight of from 19.5 to 29.0 g.

Preferably, the spherical center may be a solid center made of vulcanized rubber, preferably having an intrinsic frequency of from 2,500 to 3,400 Hz. The solid center may preferably have an outer diameter of from 31 to 34 mm and a weight of from 20.0 to 28.0 g. The thread-wound golf balls of the present invention may preferably have a deformation under a load of 100 Kg of from 2.6 to 3.5 mm. Preferably, the cover may be a two-layer cover having an inner cover made of an ionomer resin having a hardness of at least 60 on the Shore D scale, and an outer cover made of a resin having a hardness of from 43 to 53 on the Shore D scale. The inner cover may preferably have a thickness of from 0.5 to 1.5 mm. The total thickness of the inner cover and the outer cover may preferably be in the range of from 1.0 to 3.0 mm.

The thread-wound golf balls of the present invention can provide a good click sound with reasonably soft and firm feel on impact, and also can improve the advantage, in travel distance, inherent to a golf ball with a solid center.

BRIEF DESCRIPTION OF THE DRAWINGS

The objects, features, and advantages of the invention will be better understood from the following description taken in conjunction with the accompanying drawings, in which.

PREFERRED EMBODIMENTS OF THE INVENTION

Figure 1:
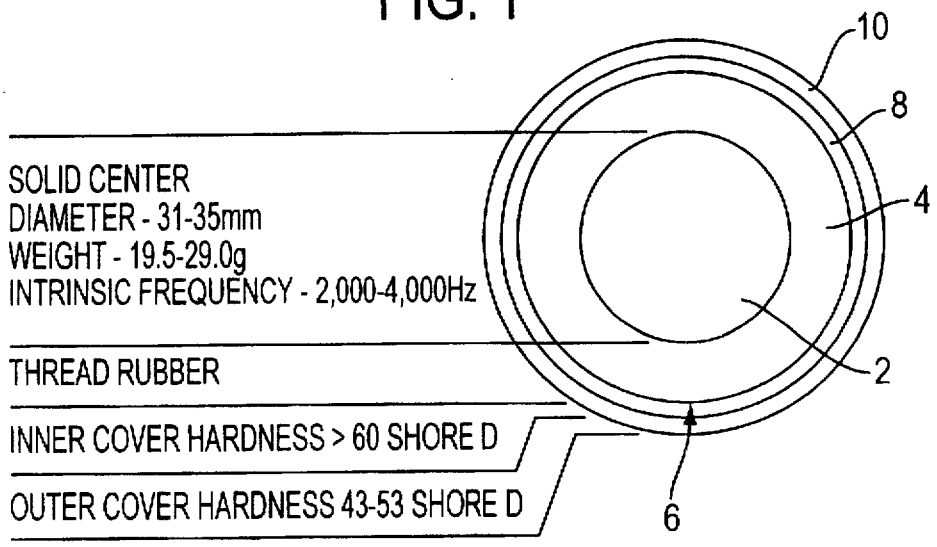
FIG. 1 shows a cross-sectional view of a thread-wound golf ball according to one embodiment of the present invention.

The present invention will be described in detail below.

Suitable solid centers used in the present invention are not particularly limited to, but include those made of vulcanized rubber. Such solid centers may be prepared by adding, to butadiene rubber, additives such as vulcanizing agents (cross-linkers), vulcanization accelerators, accelerator aids, activating agents, fillers or modifiers; and then subjecting the obtained mixture to vulcanization and molding.

The solid centers used in the present invention have an intrinsic frequency of from 2,000 to 4,000 Hz. As used herein, the "intrinsic frequency" means a peak frequency in power spectrum of restitution sound, which is obtained upon impact between a solid center and a steel disk sufficiently larger than the solid center, when the solid center is dropped from a height of 120 cm onto the disc. When the intrinsic frequency of the solid center is outside of the above range, good impact sound preferred by a skilled golf player cannot be obtained. In other words, when the intrinsic frequency is less than 2,000 Hz, the resulting golf ball may give a dull impact sound. When the intrinsic frequency exceeds 4,000 Hz, the resulting golf ball may give metallic impact sound. In either case, a good click sound cannot be obtained.

Further, as described later, the intrinsic frequency is in direct proportion to the hardness of the solid center. When the intrinsic frequency is less than 2,000 Hz, the feel on impact may become too soft. When the intrinsic frequency exceeds 4,000 Hz, the feel on impact may become too solid.

The solid center may preferably have an intrinsic frequency of from 2,200 to 3,600 Hz, more preferably from 2,500 to 3,400 Hz. Within such range, a golf ball giving the most preferable impact sound and feel on impact, can be obtained.

Further, the intrinsic frequency of the solid center may be adjusted by choosing appropriate hardness and size of the solid center. In other words, since the intrinsic frequency is in direct proportion to the hardness of the solid center, the intrinsic frequency can be increased by making the solid center harder, and it can be decreased by making the solid center softer. Further, in a case where the solid centers are made of the same material, the intrinsic frequency is in inverse proportion to the outer diameter of the solid center. Thus, the intrinsic frequency can be decreased by making the diameter of the solid center larger, and it can be increased by making the diameter smaller.

In a case where the solid centers have the same intrinsic frequency, the greater the outer diameter of the solid center is, the harder the solid center becomes. Thus, travel distance can be increased by making the outer diameter of the solid center larger to make its travel properties closer to those of a two-piece ball, and making the solid center harder to have increased restitution.

The above-mentioned solid centers have an outer diameter of from 30 to 35 mm, and a weight of from 19.5 to 29.0 g. The resulting golf balls comprising a solid center with an outer diameter of less than 30 mm will not give low spin and high launch angle, resulting in short travel distance. Further, the resulting golf balls comprising a solid center with an outer diameter of more than 35 mm will give unsatisfactory feel on impact and poor durability due to insufficient thickness of the thread rubber layer. The solid centers may preferably have an outer diameter of from 31 to 34 mm and a weight of from 20.0 to 28.0 g.

Further, in the present invention, the resulting golf balls have a deformation under a load of 100 Kg of from 2.5 mm to 3.7 mm. The deformation means amount of deformation (amount of distortion) under a load of 100 Kg applied to the golf ball, with the amount of deformation under an initial load of 1 Kg being fixed as 0 mm. When the deformation is less than 2.5 mm, the resulting golf ball may become too rigid, giving high spin launch (launch with great amount of spin), resulting in short travel distance. When the deformation exceeds 3.7 mm, the resulting golf balls may become too soft, giving shortage of initial velocity, resulting in short travel distance. The deformation may preferably be in the range of from 2.6 to 3.5 mm, more preferably from 2.8 to 3.4 mm.

The thread-wound golf balls of the present invention are those prepared by winding thread rubber around the above-mentioned center to form a thread rubber ball, and then enclosing the thread rubber ball with a cover. In this case, materials and types of the thread rubber and the cover; outer diameter and weight of the thread rubber ball and the resulting golf ball may be appropriately selected. In addition, methods for producing the thread-wound golf balls of the present invention are not particularly limited to, but include, for example, a method comprising forming a thread rubber ball, and then coating a single-layer cover or a multi-layer cover on the thread rubber ball by compression or injection molding.

Particularly preferred thread-wound golf balls of the present invention may be those comprising a two-layer cover having an inner cover made of an ionomer resin having a hardness of at least 60 on the Shore D scale, and an outer cover made of a resin having a hardness of from 43 to 53 on the Shore D scale. As used herein, the hardness of the resin means hardness obtained after the resin is cross-linked or vulcanized.

In the above two-layer cover, since the inner cover is made of an ionomer resin having a hardness of at least 60 on the Shore D scale, it is preferable to ensure high initial velocity. On the other hand, since the outer cover is made of a resin having a hardness of from 43 to 53 on the Shore D scale, it is preferable to ensure good spin properties and pleasant feel on impact.

Thus, the thread-wound golf balls with the above-mentioned two-layer cover according to the present invention, can give, by synergetic effects of the above-mentioned solid center and the two-layer cover, sufficient travel distance; and good spin properties, good feel on impact and good hitting sound preferred by a skilled golf player.

In this case, the ionomer resins used to form an inner cover may be those prepared by cross-linking a copolymer of an olefin having from 2 to 8 carbon atoms and an unsaturated monocarboxylic acid having from 3 to 8 carbon atoms with a metal ion such as $Na^+$, $Zn^{2+}$, $Ca^{2+}$ or $Mg^{2+}$. In addition, these ionomers may be terpolymers comprising another co-polymerizable component. Of these, preferred are those prepared by cross-linking a copolymer of ethylene and acrylic acid or methacrylic acid with $Na^+$ or $Zn^{2+}$. Most preferred ionomer resins used to form the inner cover are those having an acid content of not more than 15 percent by weight.

Further, suitable resins used to form an outer cover are not particularly limited to, but include any resins such as ionomer resins, balata, polyurethane based thermoplastic elastomers, polyester based thermoplastic elastomers and polyamide based thermoplastic elastomers. Particularly preferred are ionomer resins. Using the ionomer resins, durability of the outer cover can be improved.

When a resin used to form the outer cover has a hardness of less than 43 on the Shore D scale, the resulting golf ball will give poor initial velocity due to insufficient hardness of the outer cover, resulting in short travel distance. When a resin having a hardness of greater than 53 on the Shore D scale, is used, the resulting golf ball may not give good spin properties and reasonably soft feel on impact preferred by a skilled golf player due to rigidity of the outer cover. More preferred range of the Shore D scale hardness may be from 45 to 50. Within this range, good initial velocity, good spin properties and good feel on impact can be firmly obtained.

The inner cover may preferably have a thickness of from 0.5 to 1.5 mm, particularly from 0.7 to 1.2 mm. When the thickness is less than 0.5 mm, it sometimes may become difficult to obtain good initial velocity and good durability. When the thickness is more than 1.5 mm, feel on impact may become solid and unsatisfactory feel, resulting in unpleasant feel on impact. The outer cover may preferably have a thickness of from 0.5 to 1.5 mm, particularly from 0.7 to 1.2 mm. When the thickness is less than 0.5 mm, sufficient spin properties may not be obtained for approach shot. When the thickness is more than 1.5 mm, the travel distance may be decreased due to high spin (great amount of spin) and low launch angle.

The total thickness of the inner cover and the outer cover may preferably be in the range of from 1.0 to 3.0 mm, particularly from 1.5 to 2.5 mm. When the total thickness is less than 1.0 mm, it may become difficult to obtain good durability. When the total thickness is more than 3.0 mm, the travel distance may be decreased due to poor initial velocity, and the feel on impact may become unpleasant.

Further, in the golf balls of the present invention, a cover structure is not particularly limited to a multi-layer cover, and a single-layer cover can be also effectively used. Suitable resins used to form the single-layer cover include any resins such as ionomer resins, balata, polyurethane based thermoplastic elastomers, polyester based thermoplastic elastomers and polyamide based thermoplastic elastomers. Particularly preferred are ionomer resins. Using the ionomer resins, durability and restitution of the outer cover can be improved. In this case, preferred ionomer resins may have a hardness of at least 60 on the Shore D scale. In addition, thickness of the single-layer cover may preferably be in the range of from 1.0 to 3.0 mm, particularly from 1.5 to 2.5 mm. When the thickness is less than 1.0 mm, it may become difficult to ensure good durability. When the thickness exceeds 3.0 mm, travel distance may be decreased due to low initial velocity, and feel on impact may become unpleasant.

Since the solid center has an intrinsic frequency of from 2,000 to 4,000 Hz, the thread-wound golf balls of the present invention may give good "click" sound having a frequency of about 3,200 Hz on impact, which click sound is preferred by a skilled golf player. Also, reasonably soft and firm feel on impact can be obtained because of appropriate hardness of the solid center.

Further, since a large diameter solid center having an outer diameter of from 30 to 35 mm and a weight of from 19.5 to 29.0 g is used, the flight properties of the thread-wound golf balls may become closer to those of a two-piece ball, such as low spin (small amount of spin) and high launch angle, resulting in great travel distance, particularly when hit with a driver.

In addition, in the prior art process for preparing thread rubber balls, a liquid center or a relatively soft, solid center is frozen before winding thread rubber around the center, in order to obtain reasonable hardness of the center during the winding step. On the contrary, since the solid center used in the present invention has sufficient hardness, thread rubber can be wound around the solid center without freezing the solid center. Thus, a process for preparing a golf ball can be simplified by omitting the freezing step.

EXAMPLES AND COMPARATIVE EXAMPLES

The present invention will be described in more detail with reference to the following Examples, Comparative Examples and Reference Examples, which do not restrict the present invention.

Examples 1 to 4 and Comparative Examples 1 to 4

Thread-wound golf balls as shown in Tables 1 and 2 were prepared. These golf balls were prepared, as shown in FIG. 1, by winding thread rubber 4 around a solid center 2 to form a thread rubber ball 6, coating an inner cover 8 on the thread rubber ball 6 by compression molding, and then coating an outer cover 10 on the inner cover 8 by compression molding.

Tables 1 and 2 show the formulation, outer diameter, weight, hardness and intrinsic frequency of the solid center; and properties of the thread rubber balls and the resulting golf balls. The solid centers were prepared by subjecting the rubber compositions as described in Table 1 to vulcanization at 155° C. for 15 minutes. In addition, "Percumyl D" is a trade name of dicumyl peroxide produced by Nihon Yushi, and "Perhexa 3M" is a trade name of 1,1-di-t-butylperoxy-3,3,5-trimethylcyclohexane produced by Nihon Yushi.

TABLE 1

| | Examples | | | |
|---|---|---|---|---|
| | 1 | 2 | 3 | 4 |
| Solid Center Formulation (p.b.w) | | | | |
| Butadiene Rubber BR01 | 100.0 | 100.0 | 100.0 | 100.0 |
| Zinc Oxide | 10.0 | 10.0 | 10.0 | 10.0 |
| Stearic Acid | 1.0 | 1.0 | 1.0 | 1.0 |
| Barium Sulfate | 57.8 | 57.8 | 59.4 | 55.8 |
| Zinc Acrylate | 20.0 | 20.0 | 14.0 | 27.0 |
| Percumyl D | 0.6 | 0.6 | 0.6 | 0.6 |
| Perhexa 3M | 0.6 | 0.6 | 0.6 | 0.6 |
| Outer Diameter (mm) | 31.5 | 31.5 | 31.5 | 31.5 |
| Weight (g) | 23.0 | 23.0 | 23.0 | 23.0 |
| Hardness (mm) | 1.7 | 1.7 | 2.6 | 1.2 |
| Intrinsic frequency (Hz) | 3100 | 3100 | 2200 | 3600 |
| Thread Rubber Ball | | | | |
| Outer Diameter (mm) | 40.0 | 40.0 | 40.0 | 40.0 |
| Weight (g) | 36.3 | 36.3 | 36.3 | 36.3 |
| Resulting Golf Ball | | | | |
| Outer Diameter (mm) | 42.7 | 42.7 | 42.7 | 42.7 |
| Weight (g) | 45.3 | 45.3 | 45.3 | 45.3 |
| Hardness (mm) | 2.9 | 3.5 | 2.9 | 2.9 |
| Results of Distance Test | | | | |
| Head Speed 50 m/s | | | | |
| Spin Quantity (rpm) | 2660 | 2540 | 2630 | 2790 |
| Initial Velocity (m/s) | 73.1 | 72.8 | 73.1 | 73.0 |
| Launch Angle (degree) | 9.2 | 9.3 | 9.2 | 9.2 |
| Carry Travel Distance (m) | 233.2 | 230.9 | 231.9 | 232.5 |
| Total Travel Distance (m) | 241.6 | 240.3 | 240.7 | 240.4 |
| Head Speed 45 m/s | | | | |
| Spin Quantity (rpm) | 2870 | 2790 | 2840 | 3080 |
| Initial Velocity (m/s) | 66.0 | 65.8 | 65.8 | 65.9 |
| Launch Angle (degree) | 9.0 | 9.1 | 9.0 | 8.9 |
| Carry Travel Distance (m) | 208.7 | 207.5 | 207.3 | 208.9 |
| Total Travel Distance (m) | 217.8 | 217.4 | 216.2 | 216.5 |
| Results of Durability Test | | | | |
| Defective Unit Rate (No./No.) | 0/30 | 0/30 | 0/30 | 0/30 |
| Results of Feel on Impact Test | ⊙ | ⊙ | ⊙ | ⊙ |

TABLE 2

| | Comparative Examples | | | |
|---|---|---|---|---|
| | 1 | 2 | 3 | 4 |
| Solid Center Formulation (p.b.w) | | | | |
| Butadiene Rubber BR01 | 100.0 | 100.0 | 100.0 | 100.0 |
| Zinc Oxide | 10.0 | 10.0 | 10.0 | 10.0 |
| Stearic Acid | 1.0 | 1.0 | 1.0 | 1.0 |
| Barium Sulfate | 60.1 | 55.0 | 57.8 | 57.8 |
| Zinc Acrylate | 8.0 | 30.0 | 20.0 | 20.0 |
| Percumyl D | 0.6 | 0.6 | 0.6 | 0.6 |
| Perhexa 3M | 0.6 | 0.6 | 0.6 | 0.6 |
| Outer Diameter (mm) | 31.5 | 31.5 | 31.5 | 31.5 |
| Weight (g) | 23.1 | 23.0 | 23.0 | 23.0 |
| Hardness (mm) | 3.5 | 1.0 | 1.7 | 1.7 |
| Intrinsic frequency (Hz) | 1800 | 4300 | 3100 | 3100 |
| Thread Rubber Ball | | | | |
| Outer Diameter (mm) | 40.0 | 40.0 | 40.0 | 40.0 |
| Weight (g) | 36.3 | 36.3 | 36.3 | 36.3 |

TABLE 2-continued

| | Comparative Examples | | | |
|---|---|---|---|---|
| | 1 | 2 | 3 | 4 |
| Resulting Golf Ball | | | | |
| Outer Diameter (mm) | 42.7 | 42.7 | 42.7 | 42.7 |
| Weight (g) | 45.3 | 45.3 | 45.3 | 45.3 |
| Hardness (mm) | 2.9 | 2.9 | 2.4 | 3.8 |
| Results of Distance Test | | | | |
| Head Speed 50 m/s | | | | |
| Spin Quantity (rpm) | 2610 | 2950 | 2880 | 2470 |
| Initial Velocity (m/s) | 73.1 | 72.8 | 73.2 | 72.4 |
| Launch Angle (degree) | 9.2 | 9.1 | 9.1 | 9.3 |
| Carry Travel Distance (m) | 231.0 | 225.3 | 231.2 | 224.6 |
| Total Travel Distance (m) | 239.4 | 236.7 | 238.5 | 236.2 |
| Head Speed 45 m/s | | | | |
| Spin Quantity (rpm) | 2800 | 3220 | 3120 | 2580 |
| Initial Velocity (m/s) | 65.7 | 65.6 | 66.0 | 65.2 |
| Launch Angle (degree) | 9.1 | 8.7 | 8.9 | 9.3 |
| Carry Travel Distance (m) | 207.2 | 205.1 | 208.5 | 204.8 |
| Total Travel Distance (m) | 215.9 | 211.7 | 215.6 | 210.5 |
| Results of Durability Test | | | | |
| Defective Unit Rate (No./No.) | 0/30 | 12/30 | 7/30 | 0/30 |
| Results of Feel on Impact Test | ○ | X | X | X |

The hardness and intrinsic frequency of the solid centers; and the hardness of the resulting golf balls were measured as follows.

Hardness of the Solid Center

The hardness of the solid center was determined by the amount of deformation (mm) under a load of 30 Kg applied to the solid center, with the amount of deformation under an initial load of 1 Kg being fixed as 0 mm.

Hardness of the Resulting Golf Balls

The hardness of the resulting golf balls was determined by the amount of deformation (mm) under a load of 100 Kg applied to the golf ball, with the amount of deformation under an initial load of 1 Kg being fixed as 0 mm.

Intrinsic frequency of the Solid Centers

Figure 2:
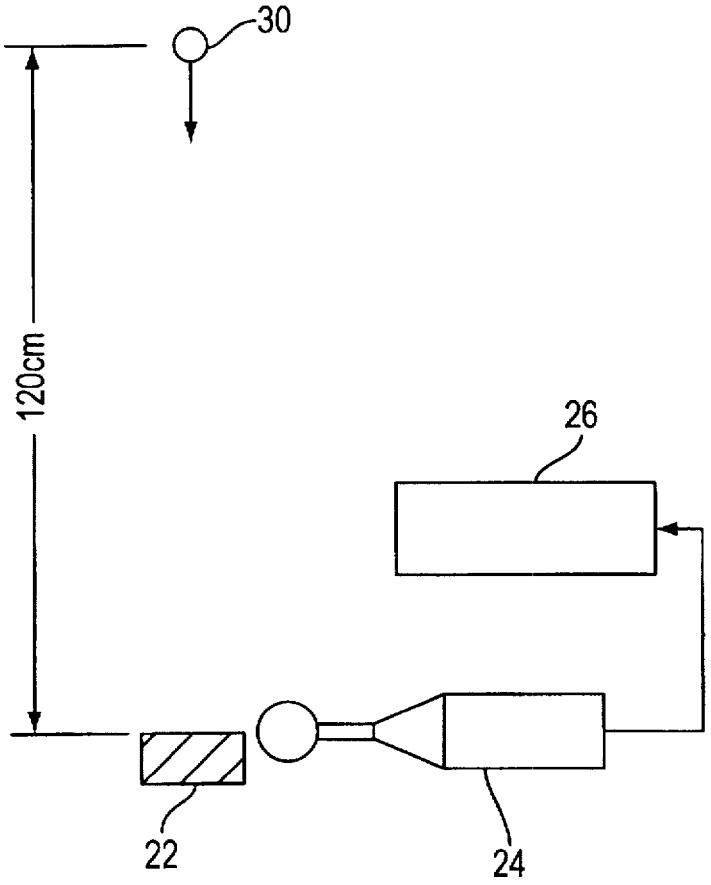
FIG. 2 shows a schematic view of an equipment used to measure intrinsic frequency of a solid center.

The intrinsic frequency was measured using equipment as shown in FIG. 2. In FIG. 2, Numerical 22 indicates a steel disc having a diameter of 20 cm and a height of 10 cm; Numerical 24 indicates a sound level meter located close to the disc 22; and Numerical 26 indicates a FFT analyzer (frequency analyzer using high speed Fourier transform). As the sound level meter 24, N-A61 produced by Rion (Range: 70 dB) was used. As the FFT analyzer, CT-360 produced by Ono Measurement Equipment was used.

Figure 3:
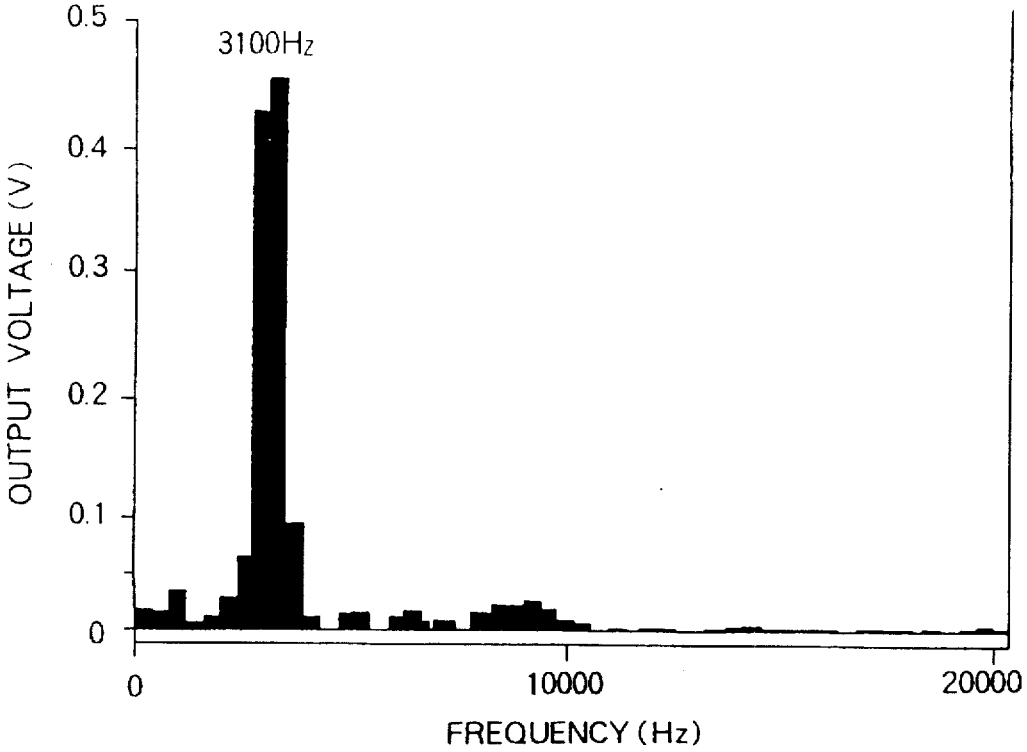
FIG. 3 shows a power spectrum of a restitution sound of a solid center used in Example 1.
Figure 4:
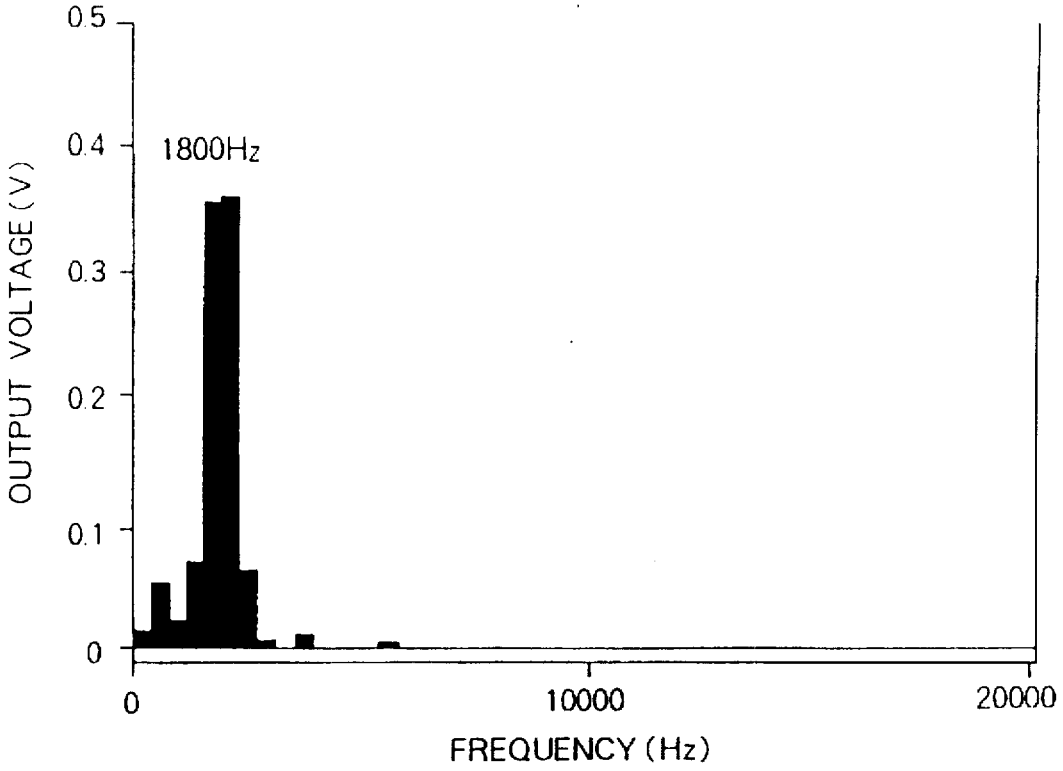
FIG. 4 shows a power spectrum of a restitution sound of a solid center used in Comparative Example 1.
Figure 5:
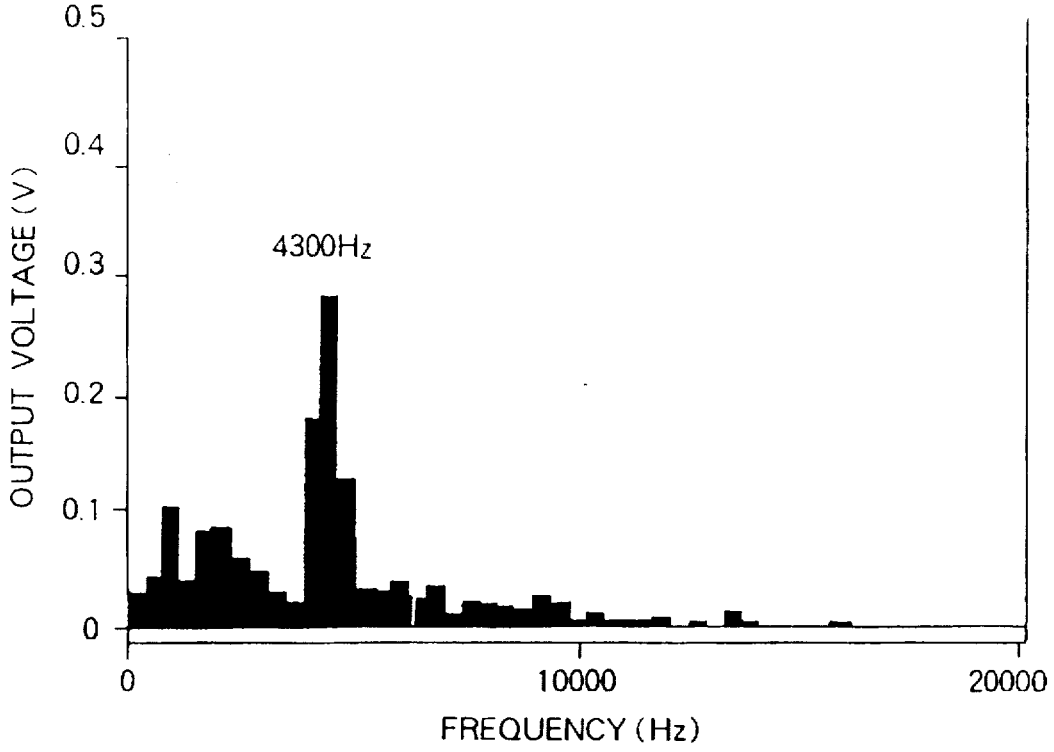
FIG. 5 shows a power spectrum of a restitution sound of a solid center used in Comparative Example 2.

The measurement using the equipment shown in FIG. 2 was conducted as follows. The solid center 30 was dropped from a height of 120 cm onto the disc 22, to collect the restitution sound generated upon impact between the disc 22 and the solid center 30. The collected sound was subjected to frequency analysis by the FFT analyzer 26 to show and record power spectrum on a computer display. The peak frequency found was determined as the intrinsic frequency. The power spectra obtained are shown in FIGS. 3 to 5. FIGS. 3 to 5 show the power spectrum obtained from the solid centers of Example 1, Comparative Example 1 and Comparative Example 2, respectively.

The resin formulations for the inner cover and the outer cover were as indicated below. "Himilan" is a trade name of an ionomer resin produced by DuPont-Mitsui Polychemical Co., Ltd.; and "Surlyn" is a trade name of an ionomer resin produced by E. I. DuPont. The thickness of both the inner cover and the outer cover was 0.8 mm.

| | |
|---|---|
| [Inner Cover] | |
| Himilan 1605 | 50 percent by weight |
| Himilan 1557 | 25 percent by weight |
| Himilan 1706 | 25 percent by weight |
| [Outer Cover] | |
| Surlyn 8120 | 50 percent by weight |
| Himilan 1557 | 50 percent by weight |

Using the thread-wound golf balls prepared in the Examples and the Comparative Examples, feeling test (sensory test), distance test, durability test and feel on impact test were conducted as follows.

Feeling Test

The golf balls were hit by three professional golfers, to give sensory evaluations on feel on impact and hitting sound.

Distance Test

Using the shooting test machine, the golf balls were hit with a No.1 Wood at a head speed of 50 m/s and 45 m/s, respectively, to measure the spin quantity, initial velocity, launch angle, carry travel distance and total travel distance.

Durability Test

Using the shooting test machine, the golf balls were hit 200 times with a No.1 Wood at a head speed of 45 m/s. The number of the balls with a fractured cover was counted. The defective unit rate was determined by the number of the balls with the fractured cover out of 30 balls.

Feel on Impact Test

The balls were hit by three professional golfers, to give sensory evaluations on feel on impact. The ratings for the evaluations were as follows.

◎: Very good feel on impact

○: Good feel on impact x: Poor feel on impact

Results of Feeling Test

Examples 1 to 4: Firm feel on impact with good "click" sound

Comparative Example 1: Soft feel on impact without "click" sound

Comparative Example 2: Solid feel on impact with metal sound

As a result, it was found that the golf balls of the present invention give good click sound with reasonably soft and firm feel on impact, and also give good travel distance. The golf balls with a single-layer cover showed also the same advantages.

On the contrary to this, the golf balls with a solid center having an intrinsic frequency of less than 2,000 Hz (Comparative Example 1) and the golf balls with a solid center having an intrinsic frequency of more than 4,000 Hz (Comparative Example 2) did not show good click sound, and gave unsatisfactory feel on impact and poor travel distance. In addition, the golf balls having a deformation under a load of 100 Kg of less than 2.5 mm (Comparative Example 3) and the golf balls having a deformation under a load of 100 Kg of more than 3.7 mm (Comparative Example 4) showed poor travel distance.

REFERENCE EXAMPLES

Reference Examples 1 to 4

The Reference Examples show embodiments of thread-wound golf balls with a two-layer cover comprising an inner cover made of an ionomer resin having a hardness of at least 60 on the Shore D scale, and an outer cover made of a resin having a hardness of from 43 to 53 on the Shore D scale; and embodiments of thread-wound golf balls with a single-layer cover made of an ionomer resin having a hardness of at least 60 on the Shore D scale. Using the same method as used in the above-mentioned Working Examples, thread-wound golf balls as shown in Table 3 were prepared. The solid centers used in the Reference Examples were the same as those used in the above-mentioned Example 1.

Table 3 shows the composition (resin formulation), acid content and Shore D scale hardness and thickness of the inner covers; the composition (resin formulation), Shore D scale hardness and thickness of the outer covers; and the properties of the solid centers, the thread rubber balls and the resulting golf balls. However, in Reference Example 4, the composition (resin formulation), acid content, Shore D scale hardness and thickness of the single-layer cover are shown in the column for the inner covers. The Shore D scale hardness was measured in accordance with ASTM 2240. The hardness of the solid centers were measured by a JIS-C testing equipment. In Table 3, in the parenthesis appearing after the trade names of the ionomer resins, types of a metal ion are indicated. Further, "Nucrel" is a trade name of an ethylene-methacrylic acid copolymer produced by DuPont-Mitsui Polychemical Co., Ltd.

TABLE 3

| | Reference Examples | | | |
|---|---|---|---|---|
| | 1 | 2 | 3 | 4 |
| Inner Cover Formulation (wt %) | | | | Single-layer |
| Himilan 1605 (Na) | 50 | 30 | | 50 |
| Himilan 1856 (Na) | | 20 | | |
| Himilan 1555 (Na) | | | 50 | |
| Himilan 1557 (Zn) | 25 | 50 | 50 | 25 |
| Himilan 1706 (Zn) | 25 | | | 25 |
| Himilan AM7317 (Zn) | | | | |
| Acid Content (wt %) | 14.0 | 12.0 | 11.0 | 14.0 |
| Shore D Hardness | 63 | 61 | 62 | 63 |
| Thickness (mm) | 0.8 | 0.8 | 0.8 | 1.4 |
| Outer Cover Formulation (wt %) | | | | |
| Surlyn 8120 (Na) | 50 | 50 | 50 | |
| Himilan 1856 (Na) | | | | |
| Himilan 1557 (Zn) | 50 | 50 | 50 | |
| Himilan 1855 (Zn) | | | | |
| Nucrel N0825J | | | | |
| Shore D Hardness | 51 | 51 | 51 | |
| Thickness (mm) | 0.8 | 0.8 | 0.8 | |
| Solid Center | | | | |
| Outer Diameter (mm) | 31.5 | 31.5 | 31.5 | 31.5 |
| Weight (g) | 23.0 | 23.0 | 23.0 | 23.0 |
| Hardness (JIS-C) | 60.4 | 60.4 | 60.4 | 60.4 |

TABLE 3-continued

| | Reference Examples | | | |
|---|---|---|---|---|
| | 1 | 2 | 3 | 4 |
| Thread Rubber Ball | | | | |
| Outer Diameter (mm) | 40.0 | 40.0 | 40.0 | 40.0 |
| Weight (g) | 36.3 | 36.3 | 36.3 | 36.3 |
| Resulting Golf Ball | | | | |
| Outer Diameter (mm) | 42.7 | 42.7 | 42.7 | 42.7 |
| Weight (g) | 45.3 | 45.3 | 45.3 | 45.3 |
| Results of Durability Test | | | | |
| Defective Unit Rate (No./No.) | 0/20 | 0/20 | 0/20 | 0/20 |
| Results of Distance Test | | | | |
| Initial Velocity (m/s) | 65.4 | 65.3 | 65.4 | 65.5 |
| Spin Quantity (rpm) | 2880 | 2900 | 2890 | 2690 |
| Launch Angle (degree) | 10.1 | 10.0 | 10.1 | 10.2 |
| Carry Travel Distance (m) | 211.8 | 211.6 | 211.7 | 212.2 |
| Total Travel Distance (m) | 227.1 | 226.7 | 227.0 | 227.2 |

The thread-wound golf balls prepared in the Reference Examples were subjected to durability test and distance test. These tests were conducted as follows.

Durability Test

Using a shooting test machine, the balls were hit 200 times with a No.1 Wood at a head speed of 45 m/s, to count the number of balls wherein the cover was fractured. The defective unit rate was determined using the number of balls with a fractured cover out of 20 balls.

Distance Test

Using the shooting test machine, the balls were hit with a No.1 Wood at a head speed of 45 m/s, to measure the initial velocity, spin quantity, launch angle, carry travel distance and total travel distance.

The results are as shown in Table 3. As shown in Table 3, it was found that the thread-wound golf balls with a two-layer cover comprising an inner cover made of an ionomer resin having a hardness of at least 60 on the Shore D scale, and an outer cover made of a resin having a hardness of from 43 to 53 on the Shore D scale (Reference Examples 1–3); and the thread-wound golf balls with a single-layer cover made of an ionomer resin having a hardness of at least 60 on the Shore D scale (Reference Example 4), show good initial velocity and sufficient travel distance, and give sufficient durability and good spin properties.

We claim:

1. A thread-wound golf ball comprising; a thread rubber ball prepared by winding thread rubber around a spherical center, and a cover enclosing the thread rubber ball therewith, which golf ball has a deformation under a load of 100 Kg of from 2.5 to 3.7 mm, and wherein the center has an intrinsic frequency of from 2,000 to 4,000 Hz, an outer diameter of from 31 to 35 mm, a deformation under a load of 30 kg in the range of 1.2 to 2.6 mm, and a weight of from 19.5 to 29.0 g.

2. A thread-wound golf ball according to claim 1, wherein the center is a solid center made of vulcanized rubber.

3. A thread-wound golf ball according to claim 2, wherein the solid center has an intrinsic frequency of from 2,500 to 3,400 Hz.

4. A thread-wound golf ball according to claim 3, wherein the solid center has an outer diameter of from 31 to 34 mm and a weight of from 20.0 to 28.0 g.

5. A thread-wound golf ball according to claim 1, which has a deformation under a load of 100 Kg of from 2.6 to 3.5 mm.

6. A thread-wound golf ball according to claim 1, wherein the cover is a two-layer cover having an inner cover made of an ionomer resin having a hardness of at least 60 on the Shore D scale, and an outer cover made of a resin having a hardness of from 43 to 53 on the Shore D scale.

7. A thread-wound golf ball according to claim 6, wherein the inner cover is made of the ionomer resin prepared by cross-linking a copolymer of an olefin having from 2 to 8 carbon atoms and an unsaturated monocarboxylic acid having from 3 to 8 carbon atoms with a metal ion.

8. A thread-wound golf ball according to claim 6, wherein the outer cover is made of a resin selected from ionomer resins, balata, polyurethane based thermoplastic elastomers, polyester based thermoplastic elastomers and polyamide based thermoplastic elastomers.

9. A thread-wound golf ball according to claim 6, wherein the inner cover has a thickness of from 0.5 to 1.5 mm.

10. A thread-wound golf ball according to claim 9, wherein the total thickness of the inner cover and the outer cover is in the range of from 1.0 to 3.0 mm.

* * * * *